US010223979B2

(12) United States Patent
Zhang

(10) Patent No.: US 10,223,979 B2
(45) Date of Patent: Mar. 5, 2019

(54) LIQUID CRYSTAL DISPLAYS, STORING METHODS OF COMPENSATION DATA THEREOF, AND DATA COMPENSATION DEVICES

(71) Applicant: Shenzhen China Star Optoelectronics Technology Co., Ltd., Shenzhen, Guangdong (CN)

(72) Inventor: Hua Zhang, Guangdong (CN)

(73) Assignee: Shenzhen China Star Optoelectronics Technology Co., Ltd, Shenzhen (CN)

( * ) Notice: Subject to any disclaimer, the term of this patent is extended or adjusted under 35 U.S.C. 154(b) by 247 days.

(21) Appl. No.: 15/324,690

(22) PCT Filed: Jan. 5, 2017

(86) PCT No.: PCT/CN2017/070199

§ 371 (c)(1),
(2) Date: Jan. 7, 2017

(87) PCT Pub. No.: WO2018/058853

PCT Pub. Date: Apr. 5, 2018

(65) Prior Publication Data

US 2018/0182305 A1 Jun. 28, 2018

(51) Int. Cl.
*G09G 3/36* (2006.01)
*G09G 3/34* (2006.01)

(52) U.S. Cl.
CPC ..... *G09G 3/3406* (2013.01); *G09G 3/36* (2013.01); *G09G 3/3607* (2013.01); *G09G 3/3648* (2013.01); *G09G 2320/0233* (2013.01); *G09G 2320/0271* (2013.01);
(Continued)

(58) Field of Classification Search
CPC ..... G09G 3/3406; G09G 3/36; G09G 3/3607; G09G 2320/0271; G09G 2320/0285
See application file for complete search history.

(56) References Cited

U.S. PATENT DOCUMENTS

| | | | |
|---|---|---|---|
| 7,733,313 | B2 | 6/2010 | Hwang |
| 8,279,233 | B2 | 10/2012 | Lim |
| 2005/0190198 | A1 | 9/2005 | Koyama |

(Continued)

FOREIGN PATENT DOCUMENTS

| | | | |
|---|---|---|---|
| CN | 101369883 | A | 2/2009 |
| CN | 101877210 | A | 11/2010 |

(Continued)

*Primary Examiner* — Lixi C Simpson
(74) *Attorney, Agent, or Firm* — Andrew C. Cheng

(57) ABSTRACT

The present disclosure relates to a storing method of compensation data of liquid crystal devices (LCDs) and a data compensation device. The storing method includes obtaining a target compensation data of a target display area, comparing a data range of the target compensation data and a storable data range of a predetermined storing space to determine a shift amount, adopting an adjusting process to the target compensation data with the shift amount to obtain the storing compensation data fitting the storable data range, and storing the shift amount and storing the compensation data. In this way, not only the precision of the data compensation may be enhanced, but also the mura issue may be effectively eliminated without increasing the volume of the flash and the cost.

19 Claims, 8 Drawing Sheets

(52) U.S. Cl.
CPC ..... *G09G 2320/0285* (2013.01); *G09G 2320/0295* (2013.01); *G09G 2320/0633* (2013.01)

(56) References Cited

U.S. PATENT DOCUMENTS

| | | | | |
|---|---|---|---|---|
| 2008/0174534 | A1* | 7/2008 | Park | G09G 3/3648 345/87 |
| 2015/0062203 | A1 | 3/2015 | Sun et al. | |
| 2015/0187328 | A1* | 7/2015 | Kim | G09G 5/02 345/690 |
| 2015/0356929 | A1* | 12/2015 | Zhan | G09G 3/20 345/690 |
| 2017/0193933 | A1* | 7/2017 | Zhang | G09G 3/36 |
| 2018/0075802 | A1* | 3/2018 | Liu | G09G 3/3233 |

FOREIGN PATENT DOCUMENTS

| | | | |
|---|---|---|---|
| CN | 105427822 | A | 3/2016 |
| CN | 105654891 | A | 6/2016 |
| CN | 105913815 | A | 8/2016 |
| JP | 1994006733 | A | 1/1994 |
| KR | 20110062437 | A | 6/2011 |

* cited by examiner

LIQUID CRYSTAL DISPLAYS, STORING METHODS OF COMPENSATION DATA THEREOF, AND DATA COMPENSATION DEVICES

BACKGROUND OF THE INVENTION

1. Field of the Invention

The present disclosure relates to display technology, and more particularly to a liquid crystal display (LCD), a storing method of compensation data thereof, and a data compensation device.

2. Discussion of the Related Art

With respect to each of the pixels on a LCD panel, mura issue, i.e., the brightness of the grayscale images may be not uniform, may be fixed via mura compensation data stored within the flash. The mura compensation data is calculated via mura compensating system. The camera takes 3 to 5 grayscale images, that is, the pure-white images with different brightness. Afterward, the mura compensation data regarding the peripheral areas may be calculated by comparing the brightness thereof with a central area of the panel. In regard to the mura area having a greater brightness than that of the central area, the grayscale value is decreased by a certain amount, that is, a corresponding negative value is stored within the flash. In regard to the mura area having a lower brightness than that of the central area, the grayscale value is increased by a certain amount, that is, a corresponding positive value is stored within the flash. The data recorder then records the calculated compensation data within the flash. During operations, the timer control register (TCON) reads the mura compensation data from the flash, and the mura compensation data operates with the input signals, i.e., grayscale data, so as to show the image with uniform brightness after the mura compensation process.

Conventionally, as the grayscale values of the pixels may be different, which results the variety of the mura compensation data. However, the flash has a data storing range. When the mura compensation data is not within the data storing range, generally, the mura compensation data is stored as the maximum storing range. As such, a certain gap is between the stored mura compensation data and the real values. If the storing range of the flash is enlarged, the volume of the flash has to be correspondingly increased, which results in a higher cost.

SUMMARY

The present disclosure relates to a LCD, a storing method of compensation data thereof, and a data compensation device for conducting precise data compensation. With such configuration, the mura issue may be effectively eliminated without increasing the volume of the flash and the cost.

In one aspect, a liquid crystal device (LCD) includes: a display panel and a backlight; the display panel further includes a driver configured to: obtain a target compensation data of a target display area; determine a shift amount is zero when $a \geq A$ and $b \leq B$, and determine the shift amount is within a range from A-a to B-b when $a<A$ or $b>B$, wherein [A, B] represents a storable data range of a predetermined storing space, and [a, b] represents a data range of the target compensation data; summing up the target compensation data with the shift amount to obtain storing compensation data of the storable data range fitting the storable data range;

the LCD includes a storage storing the shift amount and the storing compensation data; and the driver further configured to obtain data signals and the storing compensation data and the shift amount stored within the storage, revert the storing compensation data by the shift amount to the target compensation data, and compensate the data signals with the target compensation data.

Wherein the driver is further configured to: determine the shift amount is within the range [A-a, B-b] when $a>A$, $b>B$, and $(a-A)>(b-B)$; and determine the shift amount is A-a when $a>A$, $b>B$, and $(a-A)<(b-B)$.

Wherein the driver is configured to: determine the shift amount is within the range [A-a, B-b] when $a<A$, $b<B$, and $(A-a)<(B-b)$; and determine the shift amount is B-b when $a<A$, $b<B$, and $(A-a)>(B-b)$.

Wherein the driver is further configured to: divide the display are into a plurality of sub-display areas when $a<A$ or $b>B$, and with respect to each of the sub-display areas, respectively compare the data range of the target compensation data with the storable data range of the predetermined storing space to determine the shift amount of each of the sub-display areas, wherein [A, B] represents the storable data range of the predetermined storing space, and [a, b] represents the data range of the target compensation data; adopt the shift amount of each of the sub-display areas to apply an adjusting process to the compensation data of each of the sub-display areas to obtain the storing compensation data fitting the storable data range; and the storage is configured to respectively store the shift amounts and the store the compensation data of each of the sub-display areas.

Wherein the method further includes: during operations of the LCD, the driver is configured to read the stored shift amount and the stored compensation data, applying a difference operation toward the stored shift amount and the stored compensation data to obtain the target compensation data so as to compensate the data signals of the display area by the target compensation data.

In another aspect, a storing method of compensation data of LCD includes: obtaining a target compensation data of a target display area; comparing a data range of the target compensation data and a storable data range of a predetermined storing space to determine a shift amount; adopting an adjusting process to the target compensation data with the shift amount to obtain the storing compensation data fitting the storable data range; and storing the shift amount and storing the compensation data.

Wherein the step of comparing the data range of the target compensation data and the storable data range of the predetermined storing space to determine a shift amount further includes: determining the shift amount is zero when $a \geq A$ and $b \leq B$; determining the shift amount is within the range from A-a to B-b when $a<A$ or $b>B$; and wherein [A, B] represents the storable data range of the predetermined storing space, and [a, b] represents the data range of the target compensation data.

Wherein the step of determining the shift amount is within the range from A-a to B-b when $a<A$ or $b>B$ further includes: determining the shift amount is within the range [A-a, B-b] when $a>A$, $b>B$, and $(a-A)>(b-B)$; and determining the shift amount is A-a when $a>A$, $b>B$, and $(a-A)<(b-B)$.

Wherein the step of determining the shift amount is within the range from A-a to B-b when $a<A$ or $b>B$ further includes: determining the shift amount is within the range [A-a, B-b] when $a<A$, $b<B$, and $(A-a)<(B-b)$; and determining the shift amount is B-b when $a<A$, $b<B$, and $(A-a)>(B-b)$.

Wherein the step of comparing the data range of the target compensation data and the storable data range of the predetermined storing space to determine a shift amount further includes: divide the display are into a plurality of sub-display areas when a<A or b>B, and with respect to each of the sub-display areas, respectively compare the data range of the target compensation data with the storable data range of the predetermined storing space to determine the shift amount of each of the sub-display areas, wherein [A, B] represents the storable data range of the predetermined storing space, and [a, b] represents the data range of the target compensation data; respectively adopt the shift amount of each of the sub-display areas to apply an adjusting process to the compensation data of each of the sub-display areas to obtain the storing compensation data fitting the storable data range; and respectively store the shift amounts and the store the compensation data of each of the sub-display areas.

Wherein the step of adopting the shift amount to apply an adjusting process to the target compensation data to obtain the storing the compensation data fitting the storable data range further includes: summing up the target compensation data with the shift amount to obtain the storing compensation data of the storable data range fitting the storable data range.

Wherein the method further includes: during operations of the LCD, reading the stored shift amount and the stored compensation data, and applying a difference operation toward the stored shift amount and the stored compensation data to obtain the target compensation data so as to compensate the data signals of the display area by the target compensation data.

In another aspect, a compensation device of LCDs includes: a processor configured to: obtain a target compensation data of a target display area; compare a data range of the target compensation data and a storable data range of a predetermined storing space to determine a shift amount; adopt an adjusting process to the target compensation data with the shift amount to obtain the storing compensation data fitting the storable data range; and a storage configured to store the shift amount and to store the compensation data; the processor further configured to read the stored shift amount and the stored compensation data within the storage, revert the storing compensation data by the shift amount to the target compensation data, and compensate the data signals with the target compensation data.

Wherein the processor is further configure to: determine the shift amount is zero when a≥A and b≤B;

determine the shift amount is within the range from A-a to B-b when a<A or b>B; and wherein [A, B] represents the storable data range of the predetermined storing space, and [a, b] represents the data range of the target compensation data.

Wherein the process is further configure to: determine the shift amount is within the range [A-a, B-b] when a>A, b>B, and (a-A)>(b-B); and determine the shift amount is A-a when a>A, b>B, and (a-A)<(b-B).

Wherein the process is further configure to: determine the shift amount is within the range [A-a, B-b] when a<A, b<B, and (A-a)<(B-b); and determine the shift amount is B-b when a<A, b<B, and (A-a)>(B-b).

Wherein the process is further configured to: divide the display are into a plurality of sub-display areas when a<A or b>B, and with respect to each of the sub-display areas, respectively compare the data range of the target compensation data with the storable data range of the predetermined storing space to determine the shift amount of each of the sub-display areas, wherein [A, B] represents the storable data range of the predetermined storing space, and [a, b] represents the data range of the target compensation data; respectively adopt the shift amount of each of the sub-display areas to apply an adjusting process to the compensation data of each of the sub-display areas to obtain the storing compensation data fitting the storable data range; and respectively store the shift amounts and the store the compensation data of each of the sub-display areas.

Wherein the processor is further configured to: summing up the target compensation data with the shift amount to obtain the storing compensation data of the storable data range fitting the storable data range.

Wherein the processor is further configured to: during operations of the LCD, reading the stored shift amount and the stored compensation data, and applying a difference operation toward the stored shift amount and the stored compensation data to obtain the target compensation data so as to compensate the data signals of the display area by the target compensation data.

In view of the above, the storing method of the compensation data of LCDs includes: obtaining a target compensation data of a display area; comparing the data range of the target compensation data and the storable data range of a predetermined storing space to determine a shift amount; applying an adjusting process to shift the target compensation data by the shift amount to obtain the storing compensation data fitting the storable data range; and storing the shift amount and storing the compensation data. When the target compensation data exceeds the storable data range of the predetermined storing space, the target compensation data may be precisely stored. Not only the precision may be enhanced, but also the mura issue may be effectively eliminated without increasing the volume of the flash and the cost.

DETAILED DESCRIPTION OF THE EMBODIMENTS

Embodiments of the invention will now be described more fully hereinafter with reference to the accompanying drawings, in which embodiments of the invention are shown.

Figure 1:
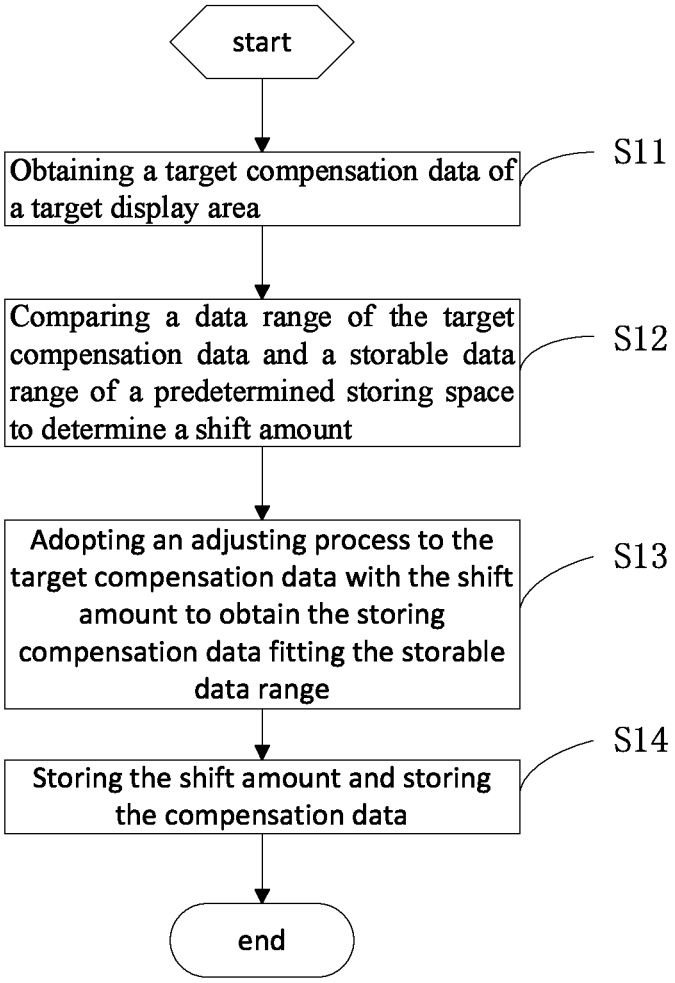
FIG. 1 is a flowchart illustrating a storing method of compensation data of LCD in accordance with a first embodiment.

FIG. 1 is a flowchart illustrating a storing method of compensation data of LCD in accordance with a first embodiment. The method includes the following steps.

In step S11, obtaining a target compensation data of a display area.

Wherein the target compensation data relates to a mura compensation data of the display area.

The mura compensation data is calculated via mura compensating system. The camera takes 3 to 5 grayscale images, that is, the pure-white images with different brightness. Afterward, the mura compensation data regarding the peripheral areas may be calculated by comparing the brightness thereof with a central area of the panel. In regard to the mura area having a greater brightness than that of the central area, the grayscale value is decreased by a certain amount, that is, a corresponding negative value is stored within the flash. In regard to the mura area having a lower brightness than that of the central area, the grayscale value is increased by a certain amount, that is, a corresponding positive value is stored within the flash. The data recorder then records the calculated compensation data within the flash. During operations, the timer control register (TCON) reads the mura compensation data from the flash, and the mura compensation data operates with the input signals, i.e., grayscale data, so as to show the image with uniform brightness after the mura compensation process.

Figure 2:
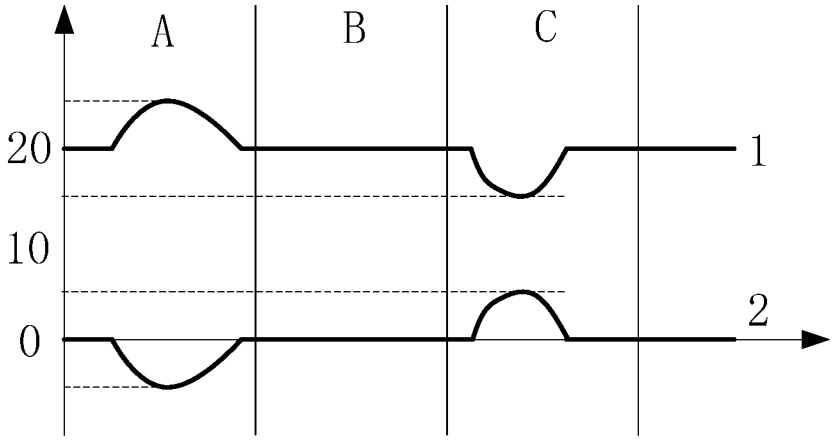
FIG. 2 is a schematic view showing the data signals and the compensation signals of the storing method of FIG. 1.

As shown in FIG. 2, the x-axis shows the display area, wherein A, B, and C represent three adjacent pixels, and y-axis shows the grayscale values. Referring to Curve 1 (original data curve), wherein B pixel is a middle pixel having the grayscale value equaling to 20. The grayscale value of pixel A is too high, and the grayscale value of pixel C is too low. Thus, Curve 1 may be compensated by Curve 2 (compensation data curve) to obtain the data signals having the grayscale value equaling to 20.

In real scenario, the compensation data is stored within the flash. As the volume of the flash is limited, that is, the data range of the flash is limited, the compensation data may not be fully stored.

In step S12, comparing a data range of the target compensation data and a storable data range of a predetermined storing space to determine a shift amount.

Generally, the mura compensation data is stored in hexadecimal. One hexadecimal data includes four bits. For instance, F, which relates to 15 stored in hexadecimal, includes four "1" (1111) stored in binary. Two hexadecimal data in high and low order can be expressed between 00 to FF all the data. As mura compensation data may be positive or negative, the highest bit out of 8 bits may be adopted to represent whether it is positive or negative, i.e., "0" represents positive, and "1" represents negative. Thus, two hexadecimal data may represent the range of the mura compensation data to be "−127~+127" (FF=11111111=−127, EF=01111111=+127). When the mura issue is serious, and some of the compensation data may exceed −127 or +127, the data is limited to be −127 or +127, and the mura compensation effect may be distorted. Here, [A, B] represents the storable data range of the predetermined storing space, that is, [A, B]=[−127, +127], and [a, b] represents the data range of the target compensation data.

The data range of the target compensation data and the storable data range of the predetermined storing space are compared. That is, [a, b] and [A, B] are compared to determine whether [a, b] is within [A, B].

When $a \geq A$ and $b \leq B$, the data range of the target compensation data is within the storable data range of the predetermined storing space, and thus shift amendment is not needed. Thus, the shift amount is zero, and the target compensation data may be stored directly.

When $a < A$ or $b > B$, at least one of ends of the data range of the target compensation data is not within the storable data range, and the shift amendment is needed. Thus, the shift amount is determined to be one value between A-a and B-b.

Several embodiments will be described hereinafter.

Figure 3:
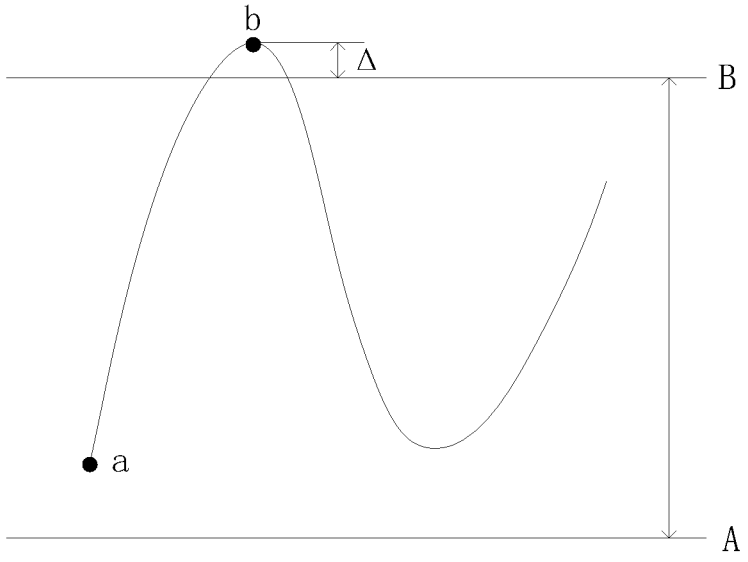
FIG. 3 is a schematic view showing the target compensation data of the storing method of FIG. 1.

As shown in FIG. 3, in the first embodiment, after the data range of the target compensation data and the storable data range of the predetermined storing space are compared, if $a>A$ and $b>B$ and $(a-A)>(b-B)$, it is determined that the lower free range of the target compensation data is greater than the upper free range of the target compensation data. As such, the shift amount may be in a range of [A-a, B-b]. That is, the target compensation data may be adjusted, i.e., the lower limit of the target compensation data equals to A, the upper limit of the target compensation data equals to B, or one value within the range from A-B.

Preferably, the shift amount may be expressed as: $\Delta=B-b$.

Figure 4:
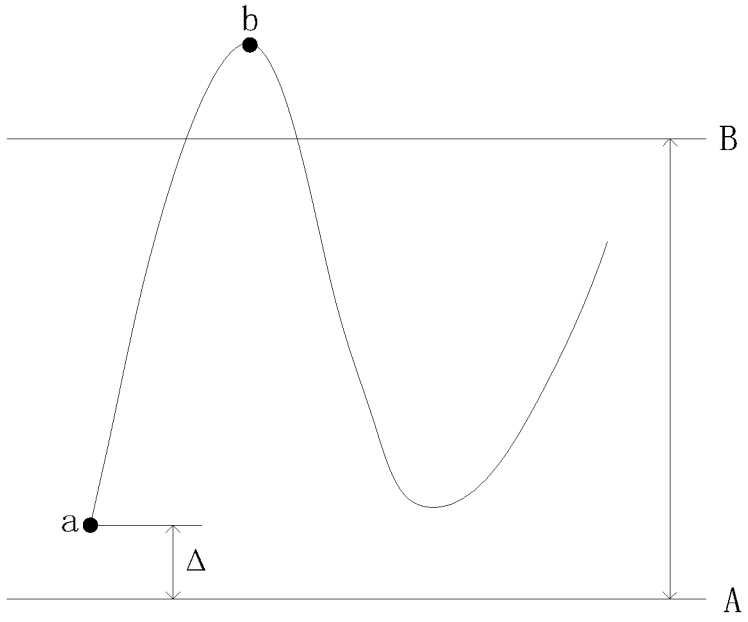
FIG. 4 is a flowchart illustrating a storing method of compensation data of LCD in accordance with a second embodiment.

As shown in FIG. 4, in the second embodiment, after the data range of the target compensation data and the storable data range of the predetermined storing space are compared, when $a>A$, $b>B$, and $(a-A)<(b-B)$, it is determined that the lower free range of the target compensation data is less than the upper free range of the target compensation data. Even if the target compensation data is shifted to the lowest end of the storable data range of the predetermined space, the maximum value the target compensation data still exceeds the storable data range of the predetermined space. At this moment, it is determined that the range of the shift amount is A-a. That is, the lower limit of the target compensation data equals to A such that the target compensation data is controlled to be within the storable data range of the predetermined space as much as possible.

Figure 5:
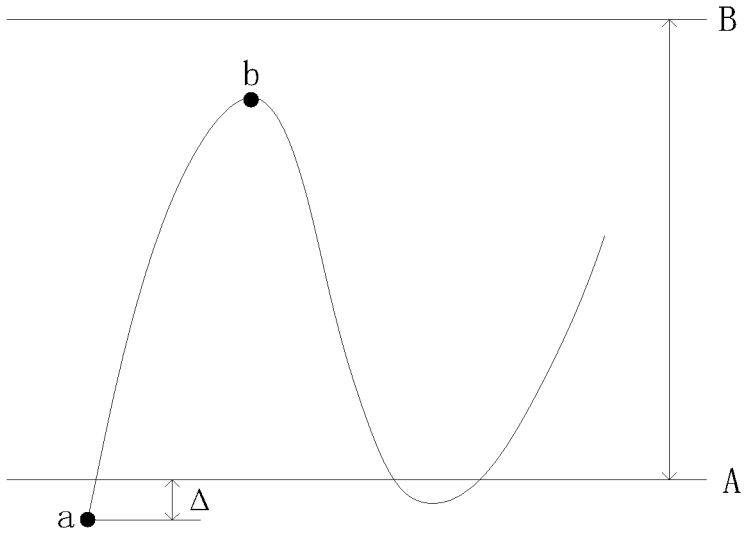
FIG. 5 is a flowchart illustrating a storing method of compensation data of LCD in accordance with a third embodiment.

As shown in FIG. 5, in the third embodiment, after the data range of the target compensation data and the storable data range of the predetermined storing space are compared, if $a<A$, $b<B$, and $(A-a)<(B-b)$, it is determined that the shift amount may be in a range of [A-a, B-b]. That is, the target compensation data may be adjusted, i.e., the lower limit of the target compensation data equals to A, the upper limit of the target compensation data equals to B, or one value within the range from A-B.

Preferably, the shift amount may be expressed as: $\Delta=A-a$.

Figure 6:
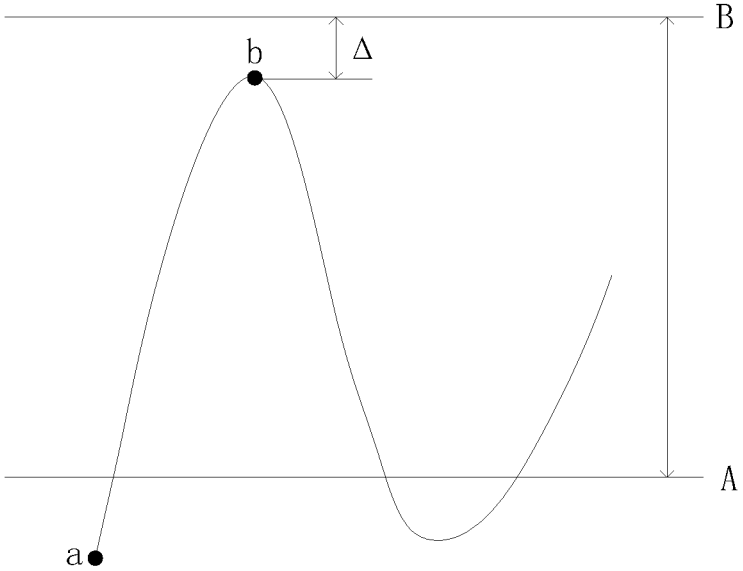
FIG. 6 is a flowchart illustrating a storing method of compensation data of LCD in accordance with a fourth embodiment.

As shown in FIG. 6, in the fourth embodiment, after the data range of the target compensation data and the storable data range of the predetermined storing space are compared, if $a>A$, $b>B$, and $(A-a)>(B-b)$, it is determined that the upper free range of the target compensation data is less than the lower free range of the target compensation data. Even if the target compensation data is shifted to the highest end of the storable data range of the predetermined space, the minimum value of the target compensation data still exceeds the storable data range of the predetermined space. At this moment, it is determined that the range of the shift amount is B-b. That is, the upper limit of the target compensation data equals to B such that the target compensation data is controlled to be within the storable data range of the predetermined space as much as possible.

In step S13, adopting an adjusting process to the target compensation data with the shift amount to obtain the storing compensation data fitting the storable data range.

In the above embodiments, regardless whether the target compensation data exceeds the upper limit or lower limit, the shift amount may be calculated by subtracting the endpoint value of the target compensation data from the endpoint value of the storable data range. That is, the configured shift amount may be positive or negative. Corresponding, when the target compensation data is adjusted, the target compensation data is summed up with the shift amount to obtain the storing compensation data within the storable data range. When the shift amount is positive, the target compensation data is moved toward the upper limit. When the shift amount is negative, the target compensation data is moved toward the lower limit.

In addition, during the operations of the LCD, the stored shift amount and the stored compensation data are read. Afterward, the difference between the stored shift amount and the stored compensation data is calculated to obtain the target compensation data. Finally, the target compensation data is adopted to compensate the data signals of the display area.

It can be understood that, in other embodiments, the shift amount may be configured as an opposite value. When the target compensation data is adjusted, the difference between the stored shift amount and the stored compensation data is calculated. When conducting the data compensation, the stored compensation data and the shift amount are summed up.

In addition, in other embodiment, the shift value may be configured as an absolute value. When the target compensation data is adjusted, the difference between or the sum of the stored shift amount and the stored compensation data may be calculated in accordance with the shifting direction.

In step S14, storing the shift amount and storing the compensation data.

That is, the shift amount and the amended storing compensation data are stored in the flash.

In one example, [A, B]=[−127, +127]. The minimum grayscale value a =−110, and the maximum grayscale value b=+133, wherein a>A, b>B, and (a-A)>(b-B). According to the first embodiment, the shift amount is determined by $-17 \leq \Delta \leq -6$. Preferably, $\Delta=-6$.

When applying an adjusting process, the target compensation data [−110, +133] is summed up with the Δ to obtain the storing compensation data [−116 , +127]. The storing compensation data is within the above storable data range [−127, +127].

Afterward, the storing compensation data [−11, +127] and the shift amount ($\Delta=-6$) are stored in the flash.

During operations, the storing compensation data [−116 , +127] and the shift amount ($\Delta=-6$) are read, and the difference operation is conducted to obtain the target compensation data [−110 , +133]. The target compensation data is adopted to compensate the data signals.

In view of the above, the storing method of the compensation data of LCDs includes: obtaining a target compensation data of a display area; comparing the data range of the target compensation data and the storable data range of a predetermined storing space to determine a shift amount; applying an adjusting process to shift the target compensation data by the shift amount to obtain the storing compensation data fitting the storable data range; and storing the shift amount and storing the compensation data. When the target compensation data exceeds the storable data range of the predetermined storing space, the target compensation data may be precisely stored. Not only the precision of the data compensation may be enhanced, but also the mura issue may be effectively eliminated without increasing the volume of the flash and the cost.

Figure 7:
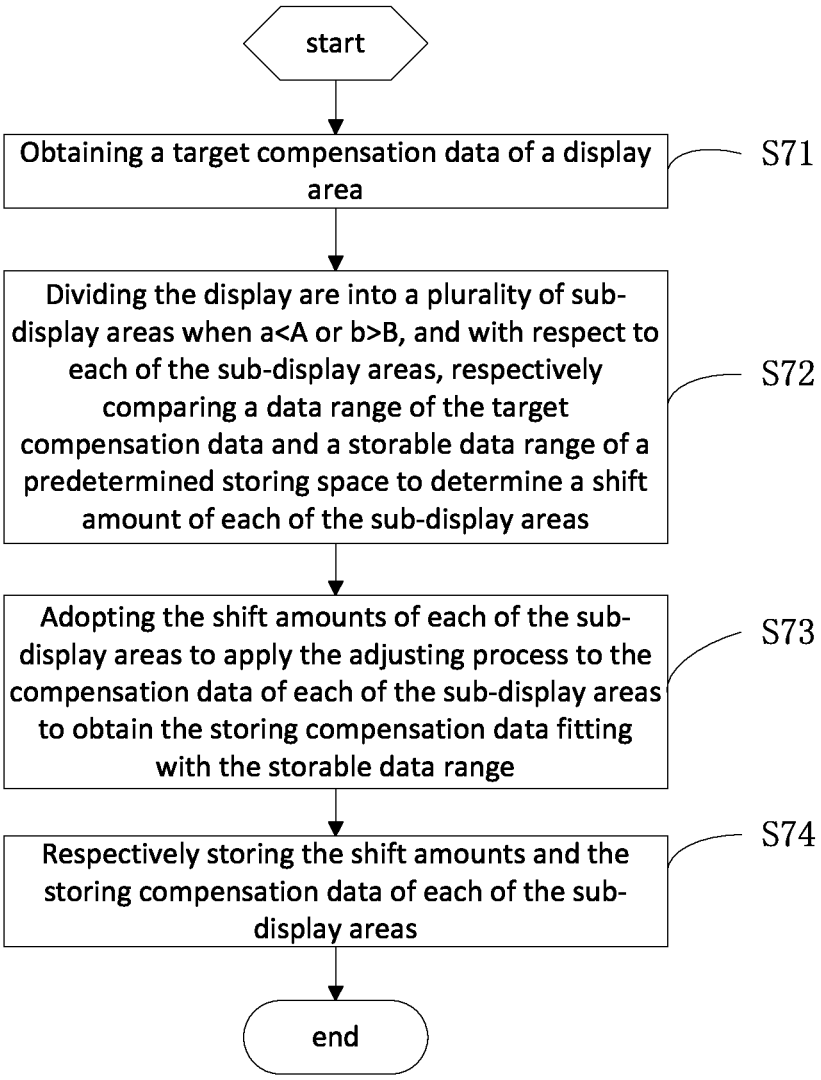
FIG. 7 is a flowchart illustrating a storing method of compensation data of LCD in accordance with a second embodiment.

FIG. 7 is a flowchart illustrating a storing method of compensation data of LCD in accordance with a second embodiment. The method includes the following steps.

In step S71, obtaining a target compensation data of a display area.

In step S72, dividing the display are into a plurality of sub-display areas when a<A or b>B, and with respect to each of the sub-display areas, respectively comparing a data range of the target compensation data and a storable data range of a predetermined storing space to determine a shift amount of each of the sub-display areas.

Wherein [A, B] represents the storable data range of the predetermined storing space, and [a, b] represents the data range of the target compensation data.

It can be understood that when a<A or b>B, at least one of ends of the data range of the target compensation data is not within the storable data range.

Figure 8:
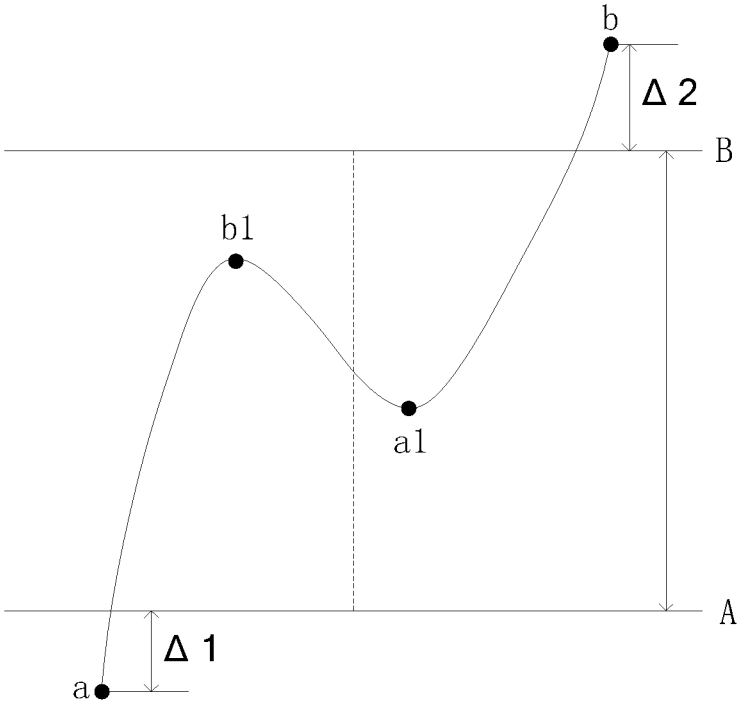
FIG. 8 is a schematic view showing the target compensation data of the storing method of FIG. 7.

As shown in FIG. 8, in one embodiment, after the data range of the target compensation data and the storable data range of the predetermined storing space are compared when a<A and b>B, the upper limit and the lower limit both exceed the storable data range of the storing space. As such, the display area may be divided into two sub-display areas, as indicated by the dashed lines in FIG. 8. The maximum grayscale value of the first sub-display area is b1, and the minimum grayscale value of the second sub-display area is a1.

With respect to the first sub-display area, the first shift amount (Δ1) is within a range from A-a to B-b1. Preferably, when A-a<B-b1, Δ1=A-a.

With respect to the second sub-display area, the second shift amount (Δ2) is within a range from b-B to a1-A. Preferably, when b-B<a1-A, Δ2=B-b.

It can be understood that the shift amount of the compensation data for each of the sub-display areas may be determined or may be adopted to apply the adjusting process by methods disclosed above.

In step S73, adopting the shift amounts of each of the sub-display areas to apply the adjusting process to the compensation data of each of the sub-display areas to obtain the storing compensation data fitting with the storable data range.

In step S74, respectively storing the shift amounts and the storing compensation data of each of the sub-display areas.

The steps S73 and S74 are similar to steps S13 and S14, and thus the detailed descriptions are omitted hereinafter.

Figure 9:
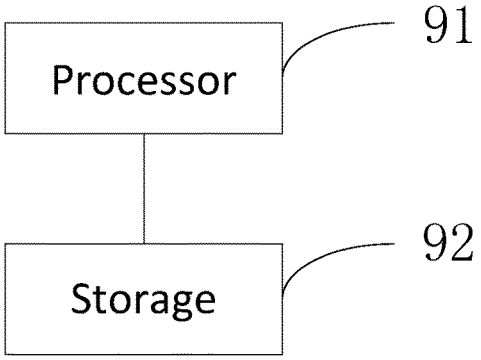
FIG. 9 is a schematic view showing the data compensation device of the LCD in accordance with one embodiment.

FIG. 9 is a schematic view showing the data compensation device of the LCD in accordance with one embodiment. The data compensation device includes:

A processor 91 configured to: obtain a target compensation data; compare a data range of the target compensation data with a storable data range of a predetermined storing space to determine a shift amount; and compensate the target compensation data by the shift amount to obtain storing compensation data of the storable data range.

A storage 92 configured to store the shift amount and the compensation data.

The processor 91 further obtains data signals and the storing compensation data and the shift amount, reverts the storing compensation data by the shift amount to target compensation data, and compensates the data signals with the target compensation data.

The processor 91 and the storage 92 may be connected by a wire, wherein the processor 91 may be a processing chip or TCON. The TCON is also referred to as a logical board, a panel driving board, and a central control board. The storage 92 may be a flash.

In one embodiment, the storage 92 is configured to: determine the shift amount is zero when a≥A and b≤B; and determine the shift amount is within a range from A-a to B-b when a<A or b>B; wherein [A, B] represents the storable data range of the predetermined storing space, and [a, b] represents the data range of the target compensation data.

Preferably, the storage 92 is configured to: divide the display area into a plurality of sub-display areas, and respectively compare the data ranges of the compensation data of each of the sub-display areas with the storable data ranges of the predetermined storing space to obtain the shift amounts of each of the sub-display areas.

Figure 10:
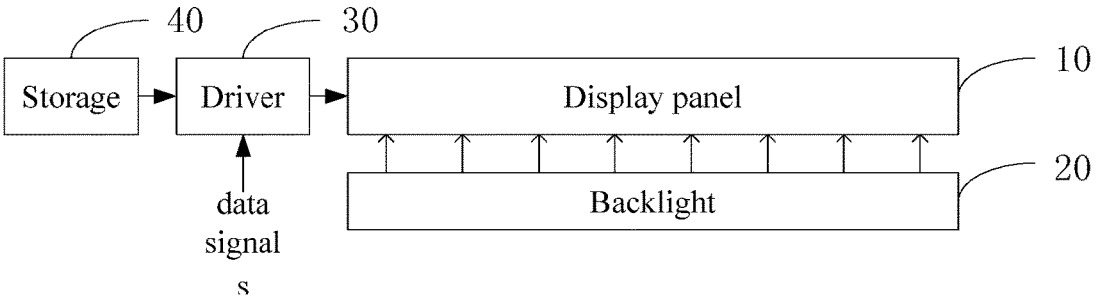
FIG. 10 is a schematic view showing the LCD in accordance with one embodiment.

FIG. 10 is a schematic view showing the LCD in accordance with one embodiment. The LCD includes a display panel 10 and a backlight 20.

The LCD further includes a driver 30 configured to: obtain the target compensation data of a target display area; compare a data range of the target compensation data with a storable data range of a predetermined storing space to determine a shift amount; and compensate the target compensation data by the shift amount to obtain storing compensation data of the storable data range.

The driver 30 may be the TCON, a logical board, a panel driving board, and a central control board.

The LCD further includes a storage 40 for storing the shift amount and the compensation data.

The storage 40 may be a flash chip within the LCD.

The driver 30 further obtains the data signals, the storing compensation data, and the shift amount. The driver 30 reverts the storing compensation data by the shift amount into a target compensation data, and compensates the data signals with the target compensation data.

Preferably, in one embodiment, the driver 30 is configured to: determine the shift amount to be zero when a≥A and b≤B; and determine the shift amount to be one value within a range from A-a to B-b; wherein [A, B] represents the storable data range of the predetermined storing space, and [a, b] represents the data range of the target compensation data.

Preferably, the driver 30 is also configured to divide the display area into a plurality of sub-display areas, and respectively compare the data ranges of the compensation data of each of the sub-display areas with the storable data ranges of the predetermined storing space to obtain the shift amounts of each of the sub-display areas.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A liquid crystal device (LCD), comprising:

a display panel and a backlight;

the display panel further comprises a driver configured to:

obtain a target compensation data of a target display area;

determine a shift amount is zero when a≥A and b≤B, and determine the shift amount is within a range from A-a to B-b when a<A or b>B, wherein [A, B] represents a storable data range of a predetermined storing space, and [a, b] represents a data range of the target compensation data;

summing up the target compensation data with the shift amount to obtain storing compensation data of the storable data range fitting the storable data range;

the LCD comprises a storage storing the shift amount and the storing compensation data; and the driver further configured to obtain data signals and the storing compensation data and the shift amount stored within the storage, revert the storing compensation data by the shift amount to the target compensation data, and compensate the data signals with the target compensation data.

2. The LCD as claimed in claim 1, wherein the driver is further configured to:

determine the shift amount is within the range [A-a, B-b] when a>A, b>B, and (a-A)>(b-B); and determine the shift amount is A-a when a>A, b>B, and (a-A)<(b-B).

3. The LCD as claimed in claim 1, wherein the driver is configured to:

determine the shift amount is within the range [A-a, B-b] when a<A, b<B, and (A-a)<(B-b); and determine the shift amount is B-b when a<A, b<B, and (A-a)>(B-b).

4. The LCD as claimed in claim 1, wherein the driver is further configured to:

divide the display are into a plurality of sub-display areas when a<A or b>B, and with respect to each of the sub-display areas, respectively compare the data range of the target compensation data with the storable data range of the predetermined storing space to determine the shift amount of each of the sub-display areas, wherein [A, B] represents the storable data range of the predetermined storing space, and [a, b] represents the data range of the target compensation data;

adopt the shift amount of each of the sub-display areas to apply an adjusting process to the compensation data of each of the sub-display areas to obtain the storing compensation data fitting the storable data range; and the storage is configured to respectively store the shift amounts and the store the compensation data of each of the sub-display areas.

5. The LCD as claimed in claim 1, wherein the method further comprises:

during operations of the LCD, the driver is configured to read the stored shift amount and the stored compensation data, applying a difference operation toward the stored shift amount and the stored compensation data to obtain the target compensation data so as to compensate the data signals of the display area by the target compensation data.

6. A storing method of compensation data of LCD, comprising:

obtaining a target compensation data of a target display area;

comparing a data range of the target compensation data and a storable data range of a predetermined storing space to determine a shift amount;

adopting an adjusting process to the target compensation data with the shift amount to obtain the storing compensation data fitting the storable data range; and storing the shift amount and storing the compensation data.

7. The storing method as claimed in claim 6, wherein the step of comparing the data range of the target compensation data and the storable data range of the predetermined storing space to determine a shift amount further comprises:

determining the shift amount is zero when a≥A and b≤B;

determining the shift amount is within the range from A-a to B-b when a<A or b>B; and wherein [A, B] represents the storable data range of the predetermined storing space, and [a, b] represents the data range of the target compensation data.

8. The storing method as claimed in claim 7, wherein the step of determining the shift amount is within the range from A-a to B-b when a<A or b>B further comprises:

determining the shift amount is within the range [A-a, B-b] when a>A, b>B, and (a-A)>(b-B); and determining the shift amount is A-a when a>A, b>B, and (a-A)<(b-B).

9. The storing method as claimed in claim 7, wherein the step of determining the shift amount is within the range from A-a to B-b when a<A or b>B further comprises:

determining the shift amount is within the range [A-a, B-b] when a<A, b<B, and (A-a)<(B-b); and determining the shift amount is B-b when a<A, b<B, and (A-a)>(B-b).

10. The storing method as claimed in claim 6, wherein the step of comparing the data range of the target compensation data and the storable data range of the predetermined storing space to determine a shift amount further comprises:

divide the display are into a plurality of sub-display areas when a<A or b>B, and with respect to each of the sub-display areas, respectively compare the data range of the target compensation data with the storable data range of the predetermined storing space to determine the shift amount of each of the sub-display areas, wherein [A, B] represents the storable data range of the predetermined storing space, and [a, b] represents the data range of the target compensation data;

respectively adopt the shift amount of each of the sub-display areas to apply an adjusting process to the compensation data of each of the sub-display areas to obtain the storing compensation data fitting the storable data range; and respectively store the shift amounts and the store the compensation data of each of the sub-display areas.

11. The storing method as claimed in claim 6, wherein the step of adopting the shift amount to apply an adjusting process to the target compensation data to obtain the storing the compensation data fitting the storable data range further comprises:

summing up the target compensation data with the shift amount to obtain the storing compensation data of the storable data range fitting the storable data range.

12. The storing method as claimed in claim 11, wherein the method further comprises:

during operations of the LCD, reading the stored shift amount and the stored compensation data, and applying a difference operation toward the stored shift amount and the stored compensation data to obtain the target compensation data so as to compensate the data signals of the display area by the target compensation data.

13. A compensation device of LCDs, comprising:

a processor configured to:

obtain a target compensation data of a target display area;

compare a data range of the target compensation data and a storable data range of a predetermined storing space to determine a shift amount;

adopt an adjusting process to the target compensation data with the shift amount to obtain the storing compensation data fitting the storable data range; and a storage configured to store the shift amount and to store the compensation data;

the processor further configured to read the stored shift amount and the stored compensation data within the storage, revert the storing compensation data by the shift amount to the target compensation data, and compensate the data signals with the target compensation data.

14. The compensation device as claimed in claim 13, wherein the processor is further configure to:

determine the shift amount is zero when a≥A and b≤B;

determine the shift amount is within the range from A-a to B-b when a<A or b>B; and wherein [A, B] represents the storable data range of the predetermined storing space, and [a, b] represents the data range of the target compensation data.

15. The compensation device as claimed in claim 14, wherein the process is further configure to:

determine the shift amount is within the range [A-a, B-b] when a>A, b>B, and (a-A)>(b-B); and determine the shift amount is A-a when a>A, b>B, and (a-A)<(b-B).

16. The compensation device as claimed in claim 14, wherein the process is further configure to:

determine the shift amount is within the range [A-a, B-b] when a<A, b<B, and (A-a)<(B-b); and determine the shift amount is B-b when a<A, b<B, and (A-a)>(B-b).

17. The compensation device as claimed in claim 13, wherein the process is further configured to:

divide the display are into a plurality of sub-display areas when a<A or b>B, and with respect to each of the sub-display areas, respectively compare the data range of the target compensation data with the storable data range of the predetermined storing space to determine the shift amount of each of the sub-display areas, wherein [A, B] represents the storable data range of the predetermined storing space, and [a, b] represents the data range of the target compensation data;

respectively adopt the shift amount of each of the sub-display areas to apply an adjusting process to the compensation data of each of the sub-display areas to obtain the storing compensation data fitting the storable data range; and respectively store the shift amounts and the store the compensation data of each of the sub-display areas.

18. The compensation device as claimed in claim 13, wherein the processor is further configured to:

summing up the target compensation data with the shift amount to obtain the storing compensation data of the storable data range fitting the storable data range.

19. The compensation device as claimed in claim 18, wherein the processor is further configured to:

during operations of the LCD, reading the stored shift amount and the stored compensation data, and applying a difference operation toward the stored shift amount and the stored compensation data to obtain the target compensation data so as to compensate the data signals of the display area by the target compensation data.

* * * * *